US011104014B2

(12) United States Patent
Gomez

(10) Patent No.: US 11,104,014 B2
(45) Date of Patent: Aug. 31, 2021

(54) SLIDING BLADE CARRIAGE WITH BLADE RELEASE

(71) Applicant: Stanley Black & Decker, Inc., New Britain, CT (US)

(72) Inventor: Jimmy Gomez, New Britain, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 16/541,853

(22) Filed: Aug. 15, 2019

(65) Prior Publication Data

US 2020/0055202 A1 Feb. 20, 2020

Related U.S. Application Data

(60) Provisional application No. 62/764,841, filed on Aug. 16, 2018.

(51) Int. Cl.
*B26B 5/00* (2006.01)

(52) U.S. Cl.
CPC ..... *B26B 5/003* (2013.01)

(58) Field of Classification Search
CPC ..... B26B 5/00; B26B 5/001; B26B 5/003
See application file for complete search history.

(56) References Cited

U.S. PATENT DOCUMENTS

| | | | |
|---|---|---|---|
| 3,025,598 | A | 3/1962 | Nissen |
| 3,577,637 | A | 5/1971 | Braginetz |
| 3,708,881 | A | 1/1973 | Bennett |
| 3,879,847 | A | 4/1975 | Roll |
| 3,906,625 | A | 9/1975 | Gringer |
| 4,005,525 | A | 2/1977 | Gringer |
| 4,621,425 | A | 11/1986 | Stoutenberg |
| 4,663,845 | A | 5/1987 | Weimann |
| 4,939,839 | A | 7/1990 | Gorst |
| 5,025,558 | A | 6/1991 | Gilbert |

(Continued)

FOREIGN PATENT DOCUMENTS

| | | | |
|---|---|---|---|
| CH | 547686 | A | 4/1974 |
| DE | 7630209 | U1 | 1/1977 |

(Continued)

OTHER PUBLICATIONS https://www.ivyclassic.com/en/rapid-reload-retractable-utility-knife-11152.

*Primary Examiner* — Omar Flores Sanchez
(74) *Attorney, Agent, or Firm* — Gabriel A. Haboubi

(57) ABSTRACT

A tool includes a housing comprising first and second sides, and a slidable blade assembly configured to move between first, second, third positions. The blade assembly selectively receives a removable blade such that the blade is stored within the housing when the assembly is in the first position, a portion of the blade extends outwardly from the housing when the assembly is in the second position, and the blade is completely outside of the housing, and exposed for removal of the blade from the assembly without removing or separating any portion of the first side or the second side of the housing, when the assembly is in the third position. The tool further includes a first button associated with moving the slidable blade assembly between the first and second position, and a second button associated with moving the slidable blade assembly between the second and third position.

17 Claims, 8 Drawing Sheets

(56) References Cited

U.S. PATENT DOCUMENTS

| | | | |
|---|---|---|---|
| 5,054,198 | A | 10/1991 | Gmoch |
| 5,099,578 | A | 3/1992 | Jan |
| 5,644,843 | A | 7/1997 | Young |
| 5,878,501 | A | 3/1999 | Owens et al. |
| 6,161,290 | A | 12/2000 | Takamasa |
| 6,163,963 | A | 12/2000 | Huang |
| 6,314,646 | B1 | 11/2001 | Schmidt |
| 6,330,749 | B1 | 12/2001 | Khachatoorian et al. |
| 6,357,120 | B1 | 3/2002 | Khachatoorian et al. |
| 6,374,497 | B1 | 4/2002 | Sun |
| 6,393,893 | B1 | 5/2002 | Fetz et al. |
| 6,449,850 | B1 | 9/2002 | Gilbert |
| 6,460,433 | B1 | 10/2002 | Ackeret et al. |
| 6,502,311 | B1 | 1/2003 | Khachatoorian et al. |
| 6,546,632 | B2 | 4/2003 | Gilbert |
| 6,557,262 | B1 | 5/2003 | Clemence et al. |
| 6,708,360 | B2 | 3/2004 | Ackeret |
| 6,718,639 | B1 | 4/2004 | Kazanjian |
| 6,729,028 | B1 | 5/2004 | Hsu |
| 6,779,425 | B2 | 8/2004 | Ackeret et al. |
| 6,886,257 | B2 | 5/2005 | Chih |
| 6,948,409 | B2 | 9/2005 | Ackeret et al. |
| 6,966,113 | B2 | 11/2005 | Fossella |
| 6,968,622 | B2 | 11/2005 | Ping |
| 7,007,392 | B2 | 3/2006 | Ping |
| 7,040,022 | B2 | 5/2006 | Ping |
| 7,107,688 | B1 | 9/2006 | Critelli et al. |
| 7,134,207 | B2 | 11/2006 | Ping |
| 7,155,829 | B1 | 1/2007 | Sun |
| 7,178,244 | B2 | 2/2007 | Fossella |
| 7,305,770 | B2 | 12/2007 | Critelli et al. |
| 7,987,602 | B2 | 8/2011 | Kanemoto et al. |
| 8,069,571 | B2 | 12/2011 | Chung et al. |
| 8,201,336 | B2 | 6/2012 | De |
| 8,220,161 | B2 | 7/2012 | Chang |
| 8,484,854 | B2 | 7/2013 | Ho |
| 8,695,221 | B2 | 4/2014 | Hao |
| 8,793,882 | B2 | 8/2014 | Kanemoto et al. |
| 8,819,942 | B2 | 9/2014 | Chung et al. |
| 8,938,883 | B2 | 1/2015 | Gringer et al. |
| 9,205,569 | B2 | 12/2015 | Garavaglia et al. |
| 10,076,846 | B2 | 9/2018 | Ranieri et al. |
| 10,589,436 | B1 * | 3/2020 | Panosian ..... B26B 5/005 |
| 2002/0144407 | A1 | 10/2002 | Gilbert |
| 2005/0015996 | A1 | 1/2005 | Chih |
| 2008/0110027 | A1 | 5/2008 | Seber et al. |
| 2011/0197454 | A1 | 8/2011 | Zeng |
| 2011/0308090 | A1 | 12/2011 | Ho |
| 2012/0174412 | A1 | 7/2012 | Ho |
| 2013/0255002 | A1 | 10/2013 | Keers et al. |
| 2014/0096658 | A1 | 4/2014 | Bellamy |
| 2014/0317936 | A1 | 10/2014 | Wu |
| 2015/0013171 | A1 | 1/2015 | Wu |
| 2015/0246451 | A1 | 9/2015 | Robinson |
| 2015/0258696 | A1 | 9/2015 | Wang |
| 2016/0023364 | A1 | 1/2016 | Raymond |
| 2016/0039100 | A1 | 2/2016 | Wang |
| 2016/0046026 | A1 | 2/2016 | Ranieri et al. |
| 2016/0158945 | A1 * | 6/2016 | Herlitz ..... B26B 1/08 30/162 |
| 2016/0318195 | A1 | 11/2016 | Garavaglia et al. |
| 2017/0266822 | A1 * | 9/2017 | Scalise ..... B26B 29/025 |
| 2018/0272546 | A1 * | 9/2018 | Rosenhan ..... A61B 17/3213 |
| 2019/0022879 | A1 * | 1/2019 | Schekalla ..... B26B 5/003 |
| 2019/0039255 | A1 * | 2/2019 | Rosenhan ..... A61B 17/3213 |
| 2019/0077032 | A1 * | 3/2019 | Squiers ..... B26B 1/046 |
| 2020/0055202 | A1 * | 2/2020 | Gomez ..... B26B 5/003 |

FOREIGN PATENT DOCUMENTS

| | | | |
|---|---|---|---|
| DE | 20303215 | U1 | 6/2003 |
| DE | 202008004001 | U1 | 8/2008 |
| DE | 202013101416 | U1 | 8/2013 |
| WO | 2009052060 | A1 | 4/2009 |
| WO | 2009086615 | A1 | 7/2009 |

* cited by examiner

SLIDING BLADE CARRIAGE WITH BLADE RELEASE

CROSS REFERENCE TO RELATED APPLICATIONS

This application claims the benefit of the priority date of provisional application Ser. No. 62/764,841, incorporated herein by reference in its entirety.

FIELD OF THE INVENTION

The present invention relates generally to hand tools.

BACKGROUND OF THE INVENTION

Utility knives are often configured to house a replaceable blade, which can selectively retract into or extend out of the handle of the utility knife. Conventionally, utility knife blades are trapezoidal, and are configured so that one side of the blade may be used, while the other side of the blade is held within the housing, fixing the blade relative to the housing. When it is desirable to replace the blade, the blade may be rotated in the blade carriage, so that the side of the trapezoid previously used (and presumably dulled through use) is held within the housing, while the side of the trapezoid previously retained within the housing may be selectively exposed for use. Alternatively, the utility knife blade may be removed entirely (e.g., when both sides of the trapezoidal blade have been thoroughly used) so that the used trapezoidal blade may be replaced by a new blade.

Among other things, the present application relates to an improved blade carriage and sliding mechanism for extending or retracting the utility knife blade, so that the utility knife blade may be released and easily rotated for utilization of the other side of the blade, or the utility knife blade may be replaced in its entirety.

SUMMARY OF THE INVENTION

According to one aspect of this disclosure, a tool includes a housing comprising a first side and a second side, and a slidable blade assembly configured to slidably move between a first position, a second position, and a third position. The slidable blade assembly is configured to selectively receive a removable blade such that the blade is stored within the housing when the slidable blade assembly is in the first position, a portion of the blade extends outwardly from the housing when the slidable blade assembly is in the second position, and the blade is completely outside of the housing, and exposed for removal of the blade from the slidable blade assembly without removing or separating any portion of the first side or the second side of the housing, when the slidable blade assembly is in the third position. The housing comprises a guide path associated with movement of the slidable blade assembly, the guide path including a first path portion associated with the slidable blade assembly being in the first position and the second position, and a second path portion associated with the slidable blade assembly being in the third position. The slidable blade assembly comprises a first button associated with moving the slidable blade assembly between the first position and the second position along the first path portion, and a second button associated with moving the slidable blade assembly between the second position and the third position along the second path portion.

According to another aspect of this disclosure, a tool includes a housing comprising a first side and a second side. The tool also includes a slidable blade assembly configured to slidably move along a guide path between a first position, a second position, and a third position. The slidable blade assembly is configured to selectively receive a removable blade such that the blade is stored within the housing when the slidable blade assembly is in the first position, a portion of the blade extends outwardly from the housing when the slidable blade assembly is in the second position, and the blade is completely outside of the housing, and exposed for removal of the blade from the slidable blade assembly without removing or separating any portion of the first side or the second side of the housing, when the slidable blade assembly is in the third position. The tool further includes a first button associated with moving the slidable blade assembly between the first position and the second position, and a second button associated with moving the slidable blade assembly between the second position and the third position.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only, and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Features of utility knives in accordance with one or more embodiments are shown in the drawings, in which like reference numerals designate like elements. The drawings form part of this original disclosure in which.

DETAILED DESCRIPTION OF THE ILLUSTRATED EMBODIMENT(S)

Figure 1:
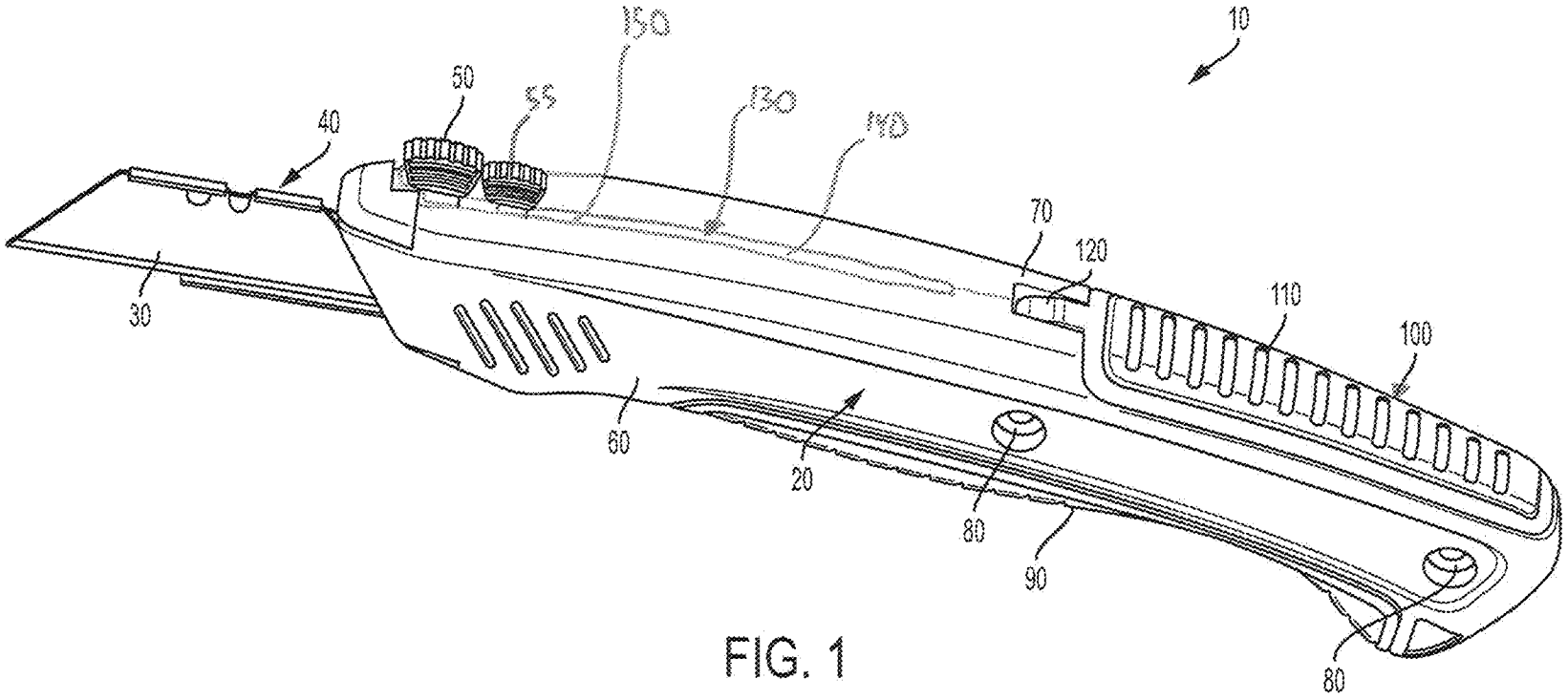
FIG. 1 illustrates a perspective view of a utility knife according to an aspect of the present disclosure.

FIG. 1 illustrates a perspective view of a utility knife 10 of the present disclosure. The utility knife 10 includes a housing 20, configured to receive a utility blade 30 therein. It may be appreciated that in the present disclosure, a blade carriage 40 or other slidable blade assembly may carry the utility blade 30, and both a first button 50 and a second button 55 coupled to the blade carriage 40. As discussed in greater detail below, the first button 50 may allow the blade carriage 40 to be selectively retracted into or extended from the housing 20, while the second button 55 may be configured to selectively extend the blade carriage 40 to protrude forward of the housing 20 to facilitate removing, replacing, or otherwise releasing the blade 30.

In an embodiment, the housing 20 may include a first side 60 and a second side 70, which may be separately formed, but assembled and secured together. In the illustrated embodiment, screws inserted in associated screw holes 80 may fix the first side 60 to the second side 70. As further shown, in an embodiment a grip 90 may also be provided on the housing 20. In an embodiment, the grip 90 may be formed of a resilient material, configured to provide a comfortable or molded grip for a user of the utility knife 10. In an embodiment, the grip 90 may extend across the first side 60 to the second side 70, so as to further couple the first side 60 to the second side 70.

In an embodiment, the housing 20 may include blade storage 100. For example, in an embodiment the first side 60 and the second side 70 may together form a storage space selectively covered by a lid 110. As illustrated in FIG. 1, in an embodiment the first side 60 and second side 70 may be configured to receive a pivot region 120 of the lid 110, so that the lid 110 may pivot relative to the remainder of the housing 120. It may be appreciated that spare blades may be stored in the housing 20, and may be accessed by lifting the lid 110.

As described in greater detail below, in an embodiment a guide path 130 for the blade carriage 40 may be formed in the housing 20 (e.g., by the assembly of the first side 60 and the second side 70). As shown, the guide path 130 may include a rear path portion 140 and a forward path portion 150. It may be appreciated that movement of the blade carriage while the button 50 and/or the button 55 are in the rear path portion 140 may facilitate sliding the blade between a fully retracted position and one or more partially extended positions, where the blade 30 may be used for cutting operations. As shown, when the button 50 (and in some embodiments the button 55) is in the forward path portion 150, the blade carriage 40 may be extended so that the blade 30 is fully outside of the housing 20, facilitating removal and replacement of the blade 30.

Figure 2:
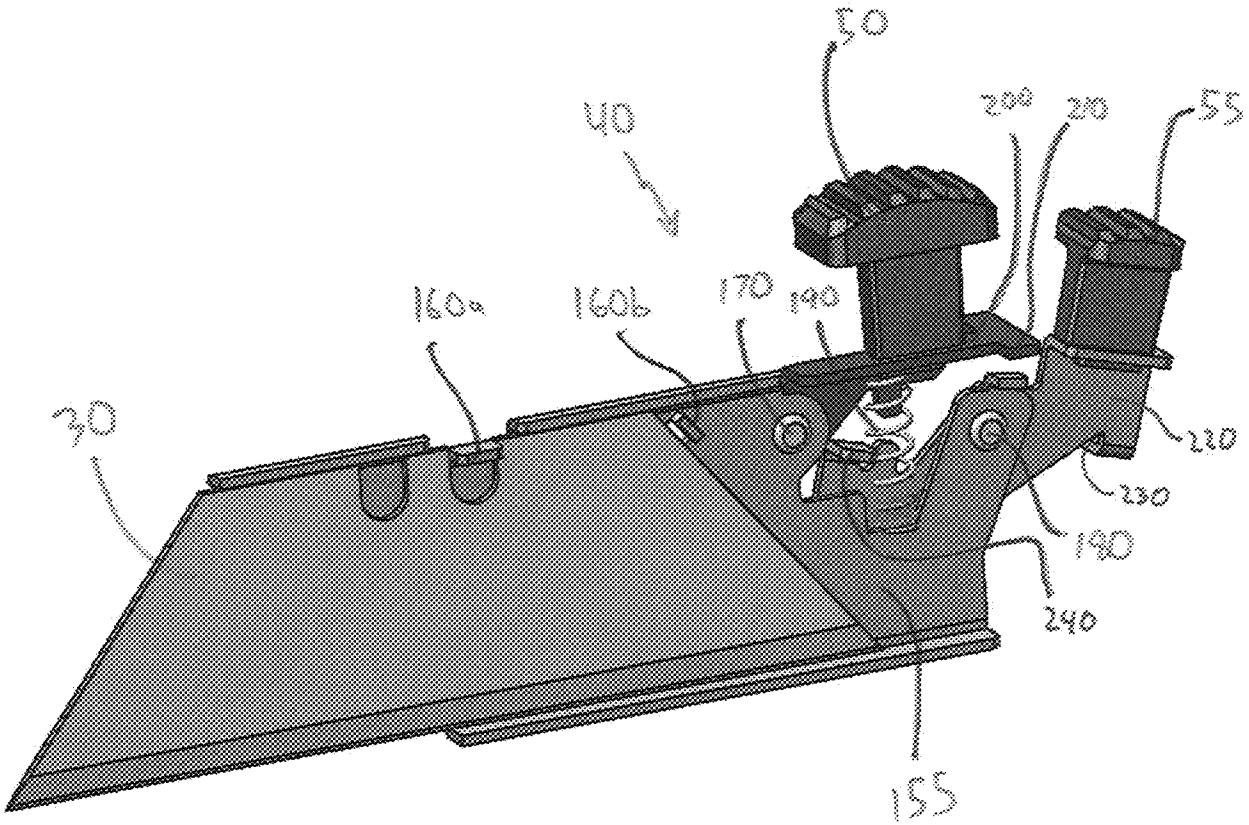
FIG. 2 illustrates an isolated front perspective view of the blade carriage of the utility knife of FIG. 1 holding a blade therein.
Figure 3:
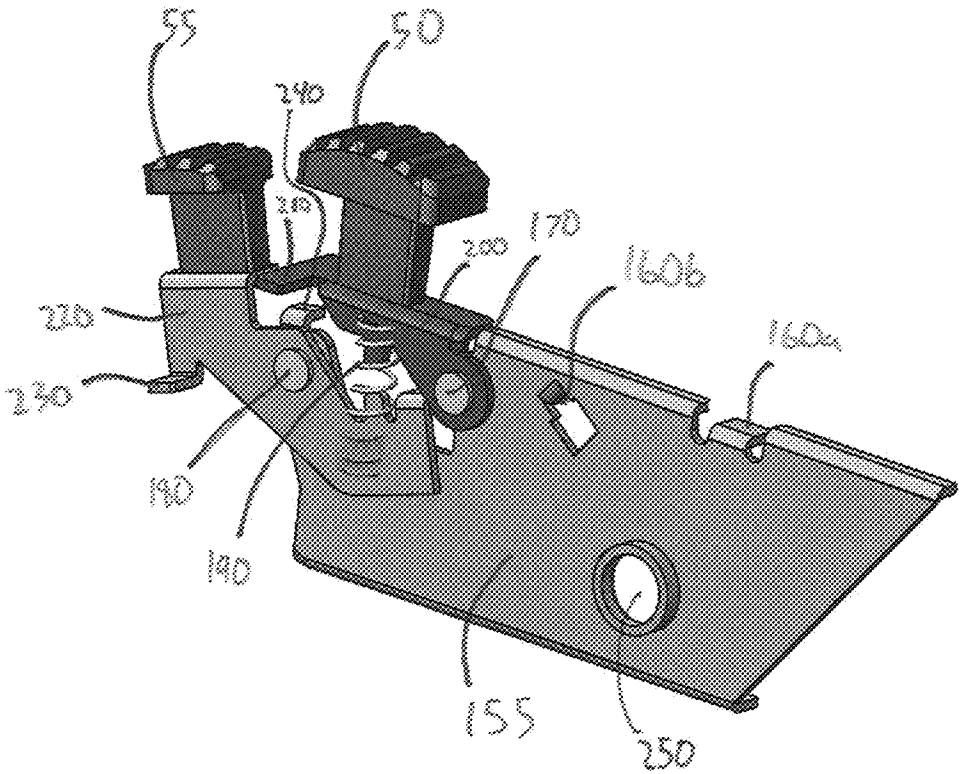
FIG. 3 illustrates an isolated rear perspective view of the blade carriage of FIG. 2, without a blade therein.

FIGS. 2 and 3 show the blade carriage 40 isolated from the remainder of the utility knife 10. As shown in FIG. 2, with the blade 30 placed therein, the blade carriage 40 may include a main body 155 having a forward portion configured to receive the blade 30. In an embodiment, the forward portion may be defined as being those regions of the blade carriage 40 that are moved external to the utility knife 10 when the blade carriage 40 is in the extended position for replacement of the blade, such as that illustrated in FIG. 1. As shown, the main body 155 may include blade notches 160*a* and 160*b* formed thereon or mounted thereto which may seat the blade 30 into the blade carriage 40.

As further shown in FIGS. 2 and 3, a rearward portion of the blade carriage 40 (e.g., a rearward portion of the main body 155) may include mounting for the buttons 50 and 55 to the blade carriage 40. As shown in the illustrated embodiment, in an embodiment the button 50 may be mounted to the remainder of the blade carriage 40 via a pivot point 170, while the button 55 may be mounted to the remainder of the blade carriage 40 via a pivot point 180. It may be appreciated that the pivot points 170 and 180 may in various embodiments comprise pins, hinges, rivets, fasteners or other appropriate mechanisms. In an embodiment, the first button 50 and the second button 55 may be biased relative to each other, such as by a biasing member 190 (e.g., a spring). In an embodiment the biasing member 190 may bias either or both of the first button 50 and the second button 55 into unpressed positions protruding from the housing 20. Accordingly, it may be appreciated that where other structures of the housing 20 limit movement of one or more of the buttons 50 or 55, the buttons 50 and/or 55 may be biased into desired positions through the biasing member 190.

As further shown, and as described below, movable members associated with each of the button 50 or the button 55 may include flanges thereon configured to engage with tracks formed in the housing 20 to facilitate movement of the blade carriage 40. For example, as shown the button 50 may be mounted on a movable member 200 which may include thereon a flange 210 that may be used to guide movement of the button 50 and structures coupled thereto (e.g., the remainder of the blade carriage 40). As shown in the illustrated embodiment, the movable member 200 may be mounted to the main body 155 via the pivot point 170. Similarly, in an embodiment the button 55 may be mounted on a movable member 220 which may include thereon a flange 230 that may be used to guide movement of the button 55 and structures coupled thereto (e.g., the remainder of the blade carriage 40). As shown in the illustrated embodiment, the movable member 220 may be mounted to the main body 155 via the pivot point 180. As further shown, in an embodiment the movable member 220 may be movement limited relative to the remainder of the blade carriage 40 by a flange 240 which may abut a portion of the main body 155 to limit rotation relative to the main body 155.

In some embodiments, the blade carriage may include a magnet thereon to hold the blade onto the carriage while the carriage is fully extended, so that the portion of the blade carriage that receives the blade is fully outside of the housing, facilitating removal and replacement of a blade therefrom. For example, FIG. 3 illustrates the main body 155 having a magnet 250 mounted thereon, which may hold the blade 30 to the blade carriage 40 through magnetic attraction between the magnet 250 and the metal of the blade 30. It may be appreciated that in various embodiments the magnet may be coupled to the blade carriage 40 through any appropriate attachment mechanism, and the magnet 250 formed of any appropriate material, including but not limited to rare earth magnets or any other appropriate magnet known in the art.

Figure 4:
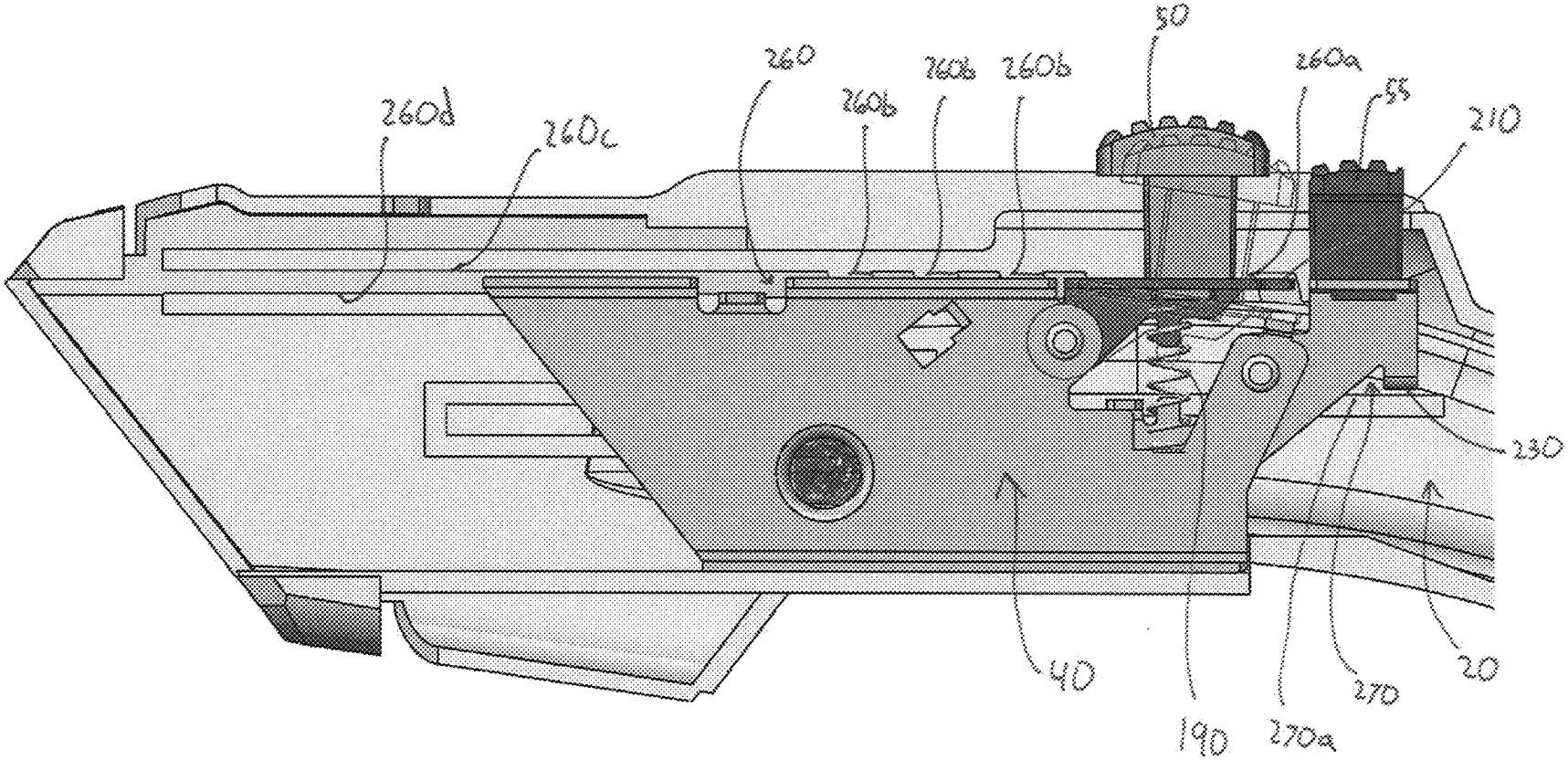
FIG. 4 illustrates a partial side view of the utility knife of FIG. 1, with one side of the housing removed, showing a sliding path for the blade carriage thereof, with the carriage positioned as when a blade would be retracted into the housing.
Figure 5:
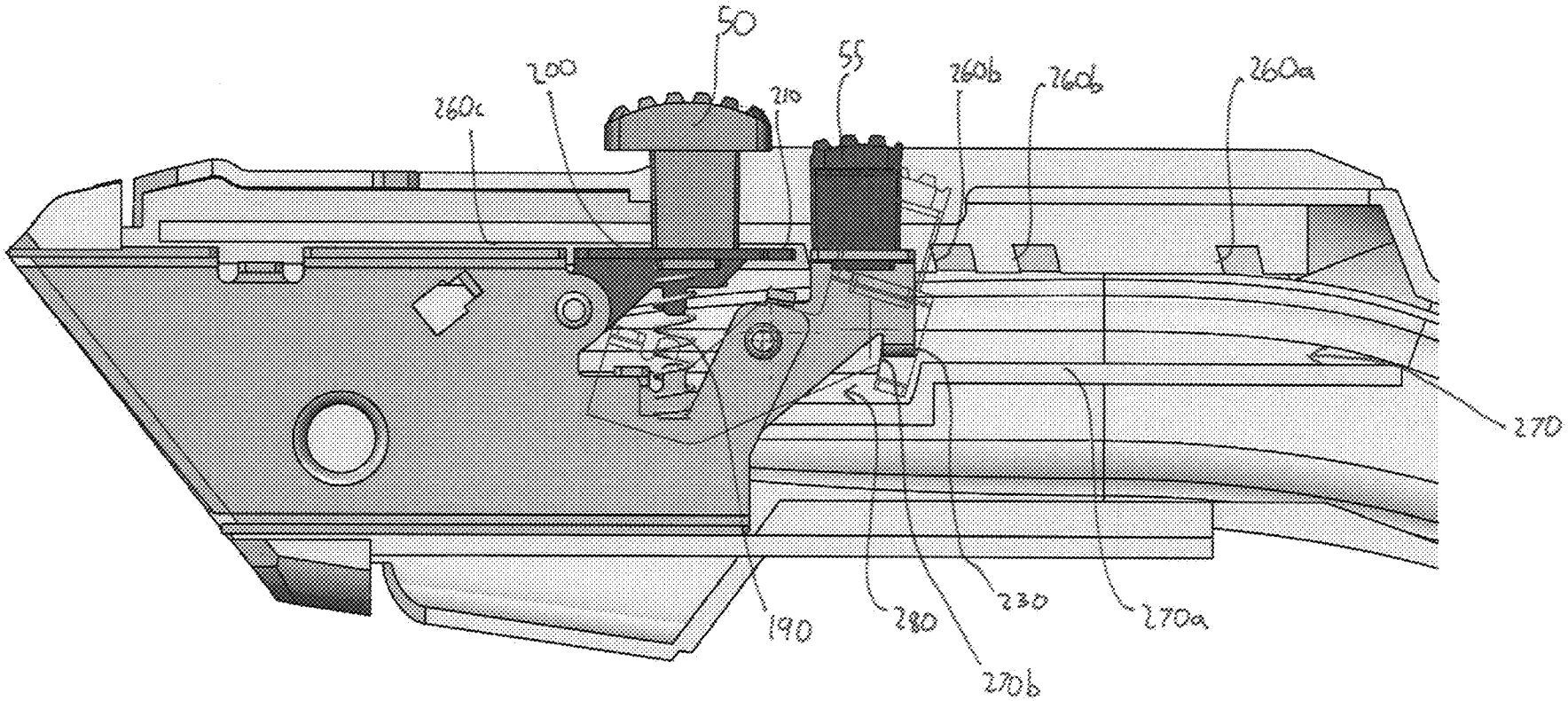
FIG. 5 illustrates a partial side view of the utility knife of FIG. 1, with one side of the housing removed, showing a sliding path for the blade carriage thereof, with the carriage positioned as when a blade would be extended from the housing for use during a cutting operation.
Figure 6:
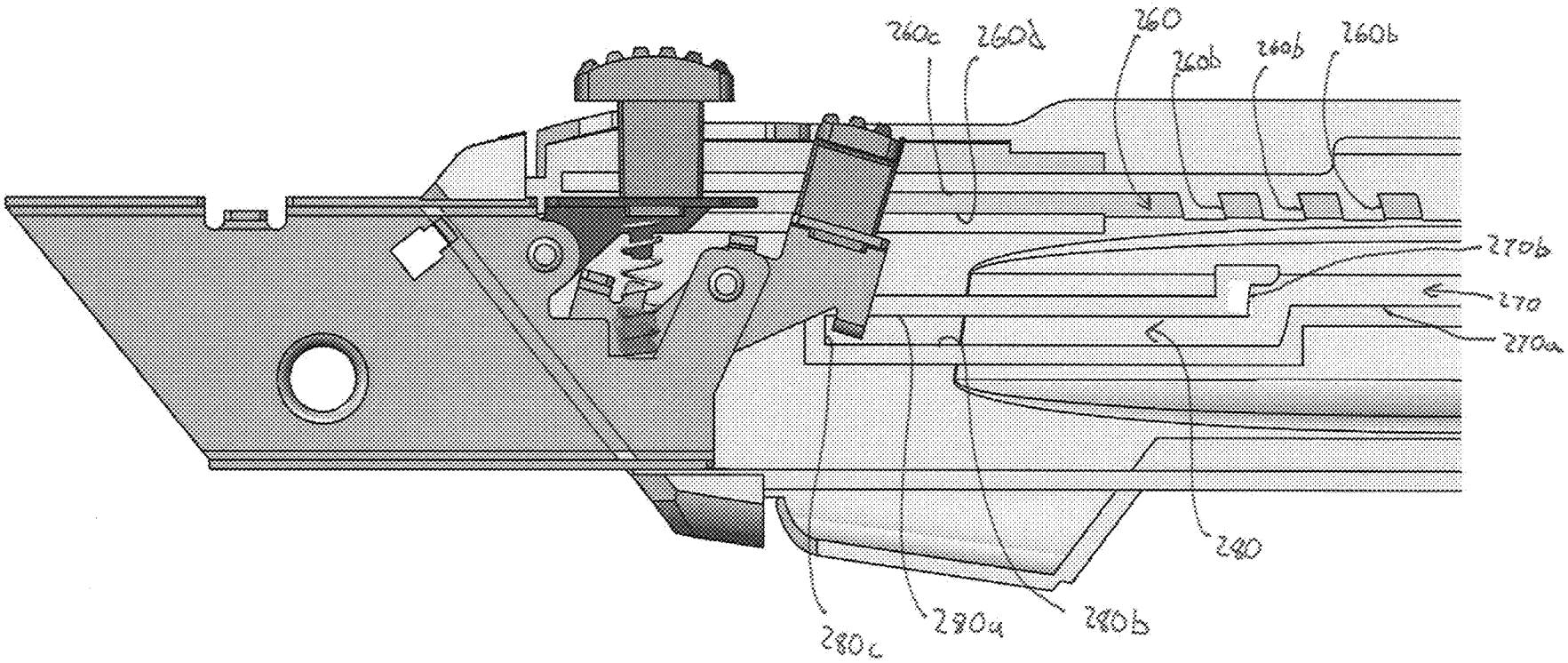
FIG. 6 illustrates a partial side view of the utility knife of FIG. 1, with one side of the housing removed, showing a sliding path for the blade carriage thereof, with the carriage positioned as when a portion of the blade carriage carrying a blade would be extended forward of the housing for replacement or removal of the blade.

FIGS. 4-6 illustrate how movement of the blade carriage 40 relative to the housing 20 along the guide path 130 may be achieved via actuations of the buttons 50 or 150, and through interaction of the flanges 10 and 230 with guide tracks formed in the housing 20 associated with the rear path portion 140 or the forward path portion 150.

FIG. 4 illustrates the blade carriage 40 in a fully retracted position in the guide path 130. As shown, a guide track 260 may have a plurality of stops that may engage the flange 210 so that movement of the blade carriage 40 along the rear path portion 140 requires pressing the button 50 (as shown in outline) so as to move the flange 210 out of a plane including the stops. As shown in FIG. 4, in an embodiment a stop 260*a* may be associated with complete retraction of the blade carriage 40 (and thus the blade 30 when installed), while one or more extended stops 260*b* may hold a portion of the blade carriage 40 (and a useable portion of the blade 30 when installed) out of the housing 20. As further shown, while the blade carriage 40 is moving within the rear path portion 140, the flange 230 associated with the button 55 may travel along a guide track 270 associated therewith. It may be appreciated that a track wall 270*a* may prevent actuation of the button 55 while the blade carriage 40 is in the rear path portion 140.

As shown in FIG. 5, when the blade carriage 40 is moved to an extended position through pressing button 50 into the housing 20 and pushing the carriage 40 forward to where the blade 30 would be fully extended for use, an opening formed by the termination of the track wall 270 may facilitate pressing the button 55 (as shown in outline) so that the flange 230 associated therewith may move from the guide track 270 to a guide track 280 associated with extending the blade carriage 40 forward so that a blade 30 could be removed or added to the forward region of the blade carriage 40 (e.g., the portion of the main body 155 defined by the blade notches 160*a* and 160*b*). It may be appreciated that in an embodiment a wall 270*b* along the guide track 270 may block forward motion of the blade carriage 40 unless the button 55 is pressed to move the flange 230 into the guide track 280. In an embodiment, the pressing of the button 55 may compress the biasing member 190 such that the button 55 (and flange 230) is biased toward the guide track 270 at the interface between guide track 270 and guide track 280 (as the button 50 and associated movable member 200 is prevented from pivoting away from the biasing member 190 through engagement of the flange 230 and a top wall 260*c* of the guide track 260).

As shown in FIG. 6, once the button 55 is pressed such that the flange 230 is in the channel of the guide track 280, the blade carriage 40 may be extended through the forward path portion 150 so that the forward region of the blade carriage 40 protrudes from the front of the housing 20, and so that a blade 30 can be lifted away from the blade carriage 40 without being obstructed by portions of the housing 20. As shown, in an embodiment the button 55 may be trapped in a pressed position by a top wall 280*a* of the guide track 280 (and limited from being further pressed by a bottom wall 280*b* of the guide track 280). As further shown, in an embodiment the button 50 may also be limited from further pressing by a bottom wall 260*d* of the guide track 260. It may be appreciated that once button 55 is pressed, a user may slide the blade carriage 40 forward through sliding movement of either or both of buttons 50 and 55 to extend the blade carriage 40 into the fully extended for blade replacement position.

In an embodiment, the blade carriage 40 may be prevented from further extension beyond where desired for removal of the blade 30 by a terminal wall 280*c* of the guide track 280. Other guide tracks or walls (including but not limited to a terminal wall in guide track 260) may alternatively or additionally limit movement of the blade carriage 40, including the buttons 50 and 55 thereof, in various embodiments.

It may be appreciated that the guide path 130 including the rear path portion 140 and the forward path portion 150 may be formed in a space between portions of the first side 60 and second side 70. In an embodiment, the space may be generally sized to receive the post extending between the movable members 200 and 220 and the user engageable regions of the buttons 50 and 55. Accordingly, the size of the space relative to the posts, along with the engagement of the flanges and the guide tracks, may prevent the blade carriage 40 from being pulled out through the space, and similarly the size of the space may prevent the buttons 50 and 55 from being pushed an undesirable depth into the housing 20.

Figure 7:
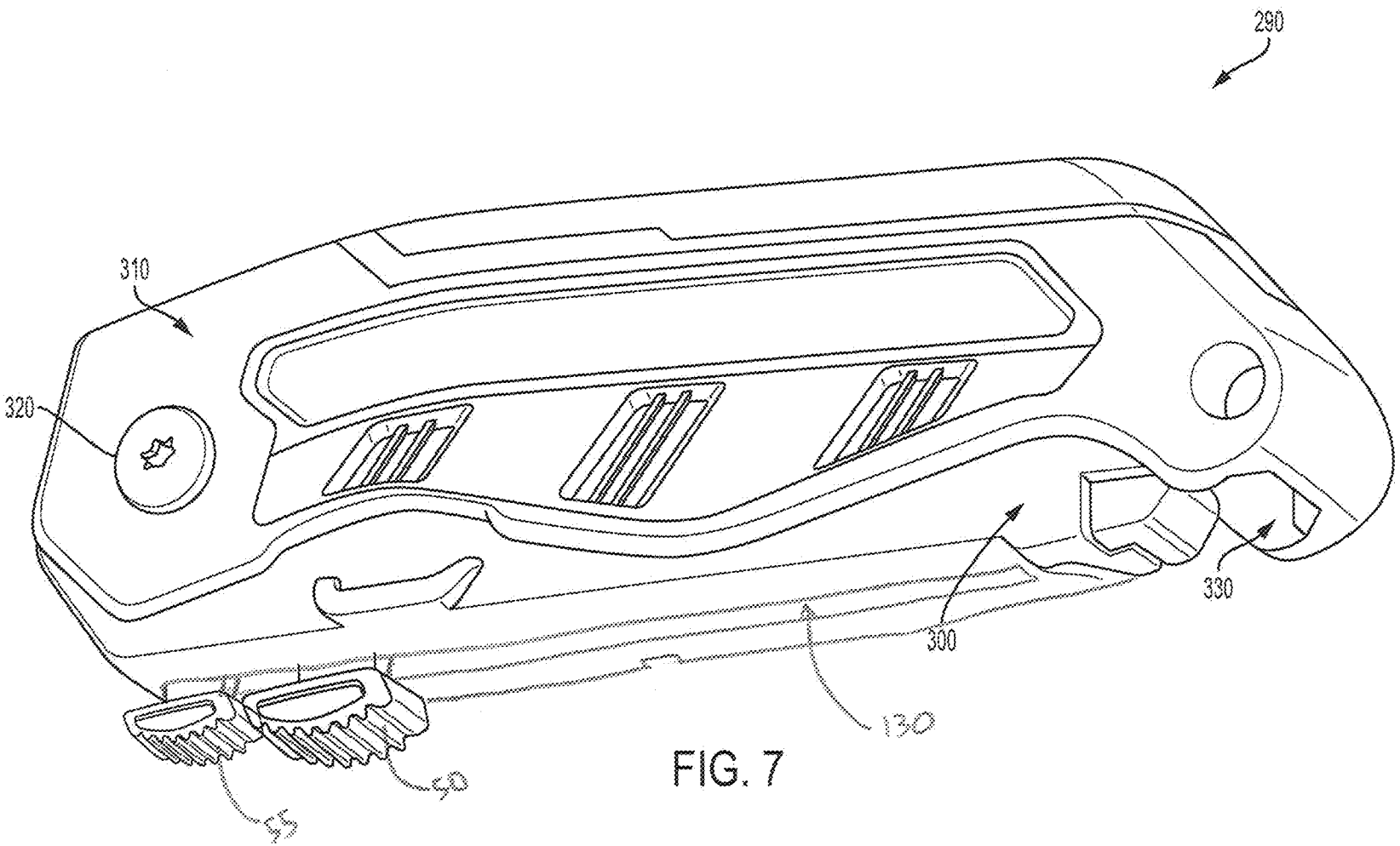
FIG. 7 illustrates a perspective view of an embodiment of a foldable utility knife according to another aspect of the present disclosure, the foldable utility knife being illustrated in a folded configuration.
Figure 8:
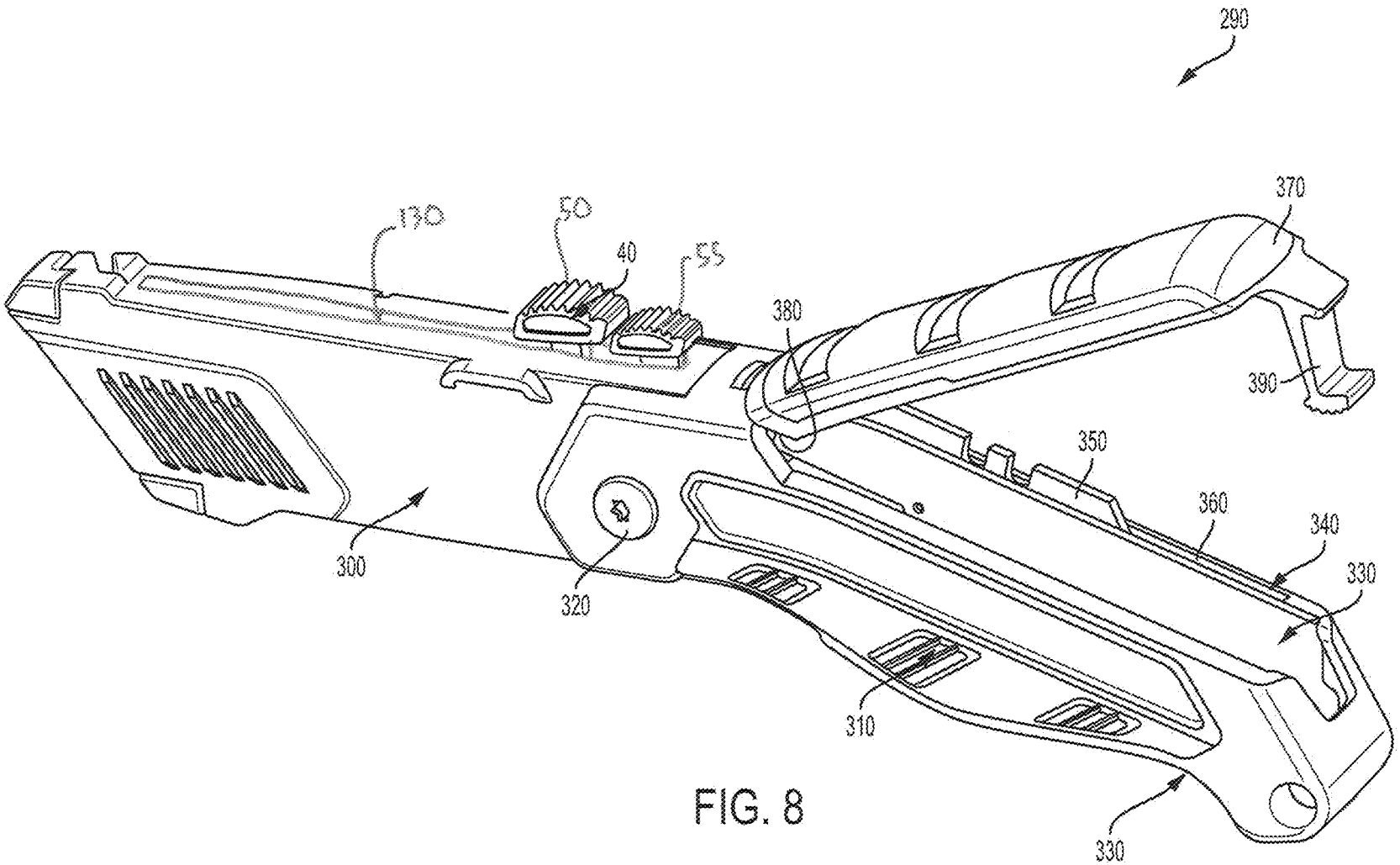
FIG. 8 illustrates a perspective view of the foldable utility knife of FIG. 7, in an unfolded configuration.

It may be appreciated that in some embodiments, features of the present disclosure may be implemented in alternate utility knife housing embodiments. For example, FIG. 7 illustrates a perspective view of an embodiment of a foldable utility knife 290. In the foldable utility knife 290, a first portion 300 that includes the guide path 130 and the blade carriage 40 may be foldable relative to a second portion 310 that may serve as a handle when the first portion 300 is folded to extend from the second portion 310 (as illustrated in FIG. 8, depicting the foldable utility knife 290 in an unfolded configuration). It may be appreciated that the first portion 300 and the second portion 310 may pivot relative to one another at a pivot 320, which in some embodiments may be formed from a bolt, rivet, screw, or other fastener. In an embodiment, the second portion 310 forms an aperture 330 into which the first portion 300 may be pivoted into for storage of the first portion 300 therein, leading to compaction of the foldable utility knife 290.

As shown in FIG. 8, in some embodiments the second portion 310 may include blade storage 340 therein for extra utility knife blades 350. As shown, in an embodiment the blade storage 340 may include a blade storage chamber 360 that may be accessed by pulling a lid 370 upwards away from the second portion 310, pivoting the lid 370 at the pivot region 380. In an embodiment the lid 370 may include a resilient catch 390 which may snap into receptacles formed in the second portion 310, and may give under sufficient force to allow the lid 370 to be pivoted away from the housing second portion 310. While in the illustrated embodiment the catch 390 is integral with the lid 370, in other embodiments the catch 390 may be coupled to the lid 370, or may be of any other appropriate configuration. As further shown in FIG. 8, in an embodiment the blade storage chamber 360 may be formed as a slot in a sidewall of the second portion 310, where an opening to which is exposed when the lid 370 is pivoted away from the second portion 310. In an embodiment, the blade storage chamber 360 may be alongside the aperture 330 into which the first portion 300 pivots when storing the first portion 300 in the second portion 310. In some embodiments, multiple blade storage chambers 360 may be located in the second portion 310 (e.g., on opposing sidewalls of the second portion 310, surrounding the aperture 330 therebetween). Other configurations of blade storage may also be used in embodiments of the utility knife 10 and the folding utility knife 290.

It may be appreciated that the components described herein may be of different constructions or configurations, including but not limited to one or more being comprised of different material choices. For example, the components described herein may each be constructed from a variety of materials, including but not limited to one or more plastics, metals, rubbers, elastomers, or any other appropriate material choice. For example, in an embodiment one or more of the components may be formed of aluminum (e.g., machined aluminum), iron (e.g., steel), or any other appropriate material. In some embodiments, the material choices may differ from component to component.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool comprising:

a housing comprising a first side and a second side;

a slidable blade assembly configured to slidably move along a guide path between a first position, a second position, and a third position, the slidable blade assembly configured to selectively receive a removable blade such that the blade is stored within the housing when the slidable blade assembly is in the first position, a portion of the blade extends outwardly from the housing when the slidable blade assembly is in the second position, and the blade is removable from the slidable blade assembly without removing or separating any portion of the first side or the second side of the housing, when the slidable blade assembly is in the third position;

a first button associated with moving the slidable blade assembly between the first position and the second position; and a second button associated with moving the slidable blade assembly into the third position;

wherein the guide path includes a first path portion associated with the slidable blade assembly being in the first position and the second position, and a second path portion associated with the slidable blade assembly being in the third position; and wherein the second button is associated with moving the slidable blade assembly into the third position along the second path portion.

2. A tool comprising:

a housing comprising a first side and a second side;

a slidable blade assembly configured to slidably move along a guide path between a first position, a second position, and a third position, the slidable blade assembly configured to selectively receive a removable blade such that the blade is stored within the housing when the slidable blade assembly is in the first position, a portion of the blade extends outwardly from the housing when the slidable blade assembly is in the second position, and the blade is completely outside of the housing, and exposed for removal of the blade from the slidable blade assembly without removing or separating any portion of the first side or the second side of the housing, when the slidable blade assembly is in the third position;

a first button associated with moving the slidable blade assembly between the first position and the second position; and a second button associated with moving the slidable blade assembly between the second position and the third position;

wherein the guide path includes a first path portion associated with the slidable blade assembly being in the first position and the second position, and a second path portion associated with the slidable blade assembly being in the third position; and wherein the second button is associated with moving the slidable blade assembly between the second position and the third position along the second path portion.

3. The tool of claim 1, wherein one or more of the first button and the second button are biased into an unpressed position.

4. The tool of claim 3, wherein the slidable blade assembly comprises a spring configured to bias both the first button and the second button into the unpressed positions.

5. The tool of claim 1, wherein when the slidable blade assembly is in the first position or the second position, sliding movement of the slidable blade assembly is prevented until the first button is pressed.

6. The tool of claim 1, wherein the guide path comprises one or more stops associated with partial extension of the removable blade between the first position and the second position.

7. The tool of claim 6 wherein a flange associated with the first button selectively abuts the one or more stops, and wherein pressing the first button disengages the flange from the one of the one or more stops.

8. The tool of claim 1, wherein the first side is coupled to the second side, and wherein a space in the housing defining the guide path is formed between the first side and the second side.

9. The tool of claim 2, wherein a track associated with the second path portion holds the second button in a pressed position when the slidable blade assembly slides through the second path portion.

10. The tool of claim 1, wherein the housing comprises a first portion pivotable relative to a second portion, such that the first portion may be stored within an aperture in the second portion.

11. The tool of claim 1, further comprising blade storage to contain one or more additional blades within the housing.

12. The tool of claim 11, wherein the blade storage is accessible via a lid pivotable relative to the housing.

13. The tool of claim 12, wherein the housing comprises a first portion pivotable relative to a second portion, such that the first portion may be stored within an aperture in the second portion; and wherein the blade storage is located adjacent to the aperture inside the second portion.

14. The tool of claim 1, wherein the slidable blade assembly comprises a magnet configured to hold the blade against the slidable blade assembly.

15. The tool of claim 1, wherein both the first button and the second button are carried on the slidable blade assembly.

16. A tool comprising:

a housing comprising a first side and a second side;

a slidable blade assembly configured to slidably move along a guide path between a first position, a second position, and a third position, the slidable blade assembly configured to selectively receive a removable blade such that the blade is stored within the housing when the slidable blade assembly is in the first position, a portion of the blade extends outwardly from the housing when the slidable blade assembly is in the second position, and the blade is completely outside of the housing, and exposed for removal of the blade from the slidable blade assembly without removing or separating any portion of the first side or the second side of the housing, when the slidable blade assembly is in the third position;

a first button associated with moving the slidable blade assembly between the first position and the second position; and a second button associated with moving the slidable blade assembly between the second position and the third position;

wherein the second button is movable with the slidable blade assembly.

17. The tool of claim 16, wherein the second button is configured to be pressed into the housing.

* * * * *